US006393630B1

(12) United States Patent
Tedrick

(10) Patent No.: US 6,393,630 B1
(45) Date of Patent: May 28, 2002

(54) SPA COVER LIFTER

(76) Inventor: John Tedrick, 4937 S. 86 E. Ave., Tulsa, OK (US) 74145

( * ) Notice: Subject to any disclaimer, the term of this patent is extended or adjusted under 35 U.S.C. 154(b) by 0 days.

(21) Appl. No.: 09/858,448

(22) Filed: May 17, 2001

(51) Int. Cl.[7] ..... E04H 4/00
(52) U.S. Cl. ..... 4/498; 4/580; 4/584
(58) Field of Search ..... 4/498, 580, 584

(56) References Cited

U.S. PATENT DOCUMENTS 4,853,985 A * 8/1989 Perry
5,048,153 A * 9/1991 Wall et al.
5,584,081 A * 12/1996 Ouelette
5,819,332 A * 10/1998 Perry
5,974,600 A * 11/1999 Pucci et al.
6,032,305 A * 3/2000 Tedrick

* cited by examiner

*Primary Examiner*—Robert M. Fetsuga
*Assistant Examiner*—Khoa Huynh

(57) ABSTRACT

A device for removing spa covers and storing them, while the spa in use, and returning them to cover the spa after use. This invention takes a different approach to the mounting requirements for the system hardware. Most notable, all weight of the covers and lifter are ground level mounted, no attachment is made to the spa.

1 Claim, 3 Drawing Sheets

SPA COVER LIFTER

BACKGROUND OF THE INVENTION

This invention relates to a lifting mechanism for removing and replacing the cover of a spa. The use of spas has become widespread, and most spas are equipped with covers which when closed prevents debris, rain and the like from contaminating the tub water. The cover further serves to retain heat within the tub. As a consequence, spa covers tend to be relatively heavy and difficult to remove and replace.

Lifting devices have been developed to aid in the removal and replacement of these relatively heavy spa covers which can be operated with varying amounts of difficulty.

Some problems exist with past lifting mechanism designs. A unit with one lifting arm can produce excessive wear on the edge of the spa and the bottom of the spa cover when the cover is slid and pushed to the "off" position.

With only one lifting arm rigidity suffers and the spa cover tends to become angularity offset when the operator pulls or pushes on one side only.

SUMMARY OF THE INVENTION

As spa development has progressed some manufactures have increased the strength and rigidity of their plastic tubs and reduced the robustness and weight of their wooden bases. This is satisfactory for the spa itself but reduces the availability of cover lifter attach points on the wooden base.

This invention attaches the cover lifter directly to the concrete or deck structure which the spa is setting upon. Thus the strength or weakness of the spa base becomes a moot issue.

BRIEF DESCRIPTION OF THE DRAWINGS

The foregoing objects and many of the attendant advantages of this invention will become more readily appreciated as the same becomes better understood by reference to the following detailed description when taken in conjunction with the accompanying drawings wherein:

FIG. (1) is a right side view of a spa with the cover shown in the "folded on" position. The right stanchions are shown attached to the ground slab or other mounting surface. The near lift bar and center lift bar are shown pivotally attached to the spa cover and stanchions.

Figure 1:
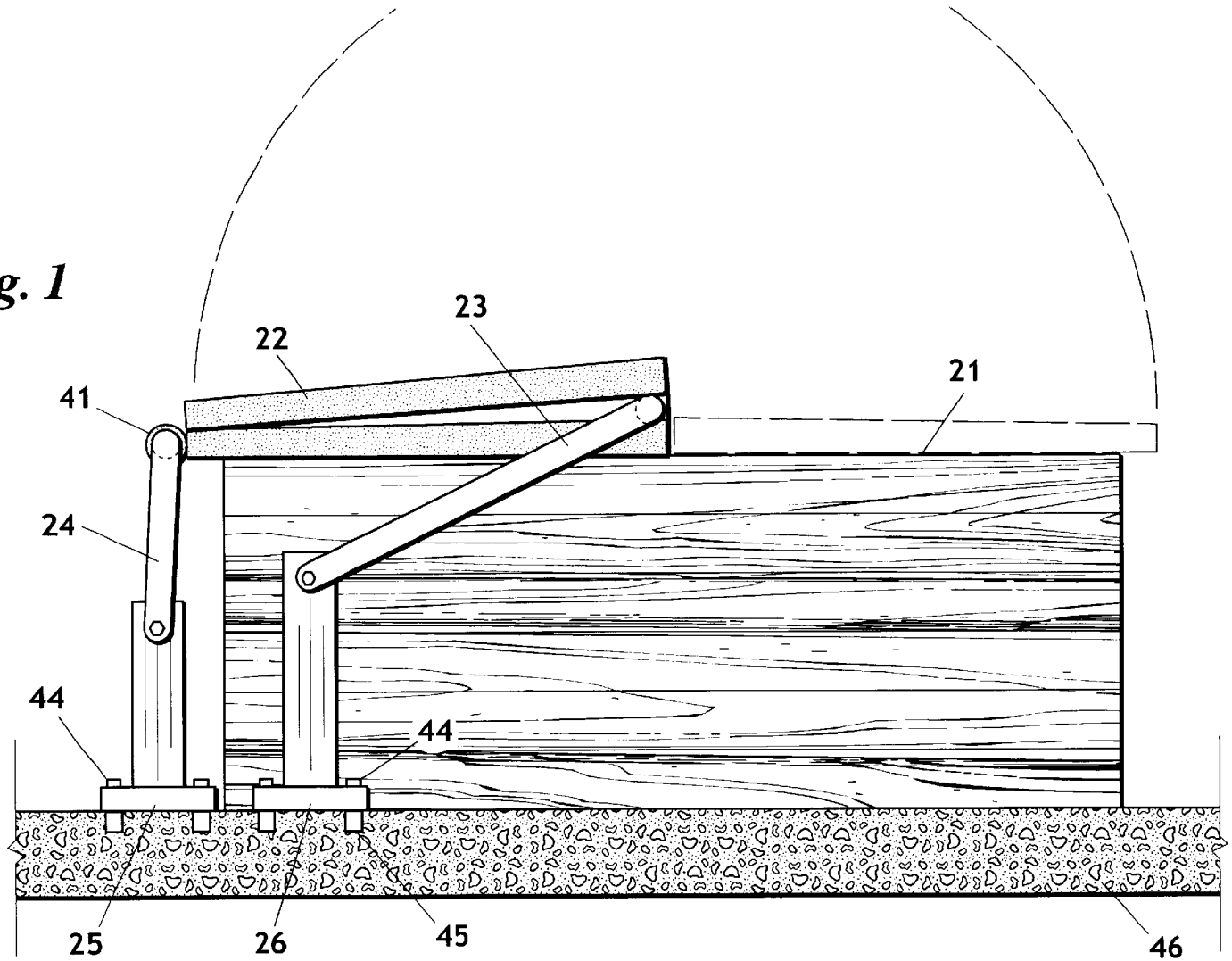
Figure 2:
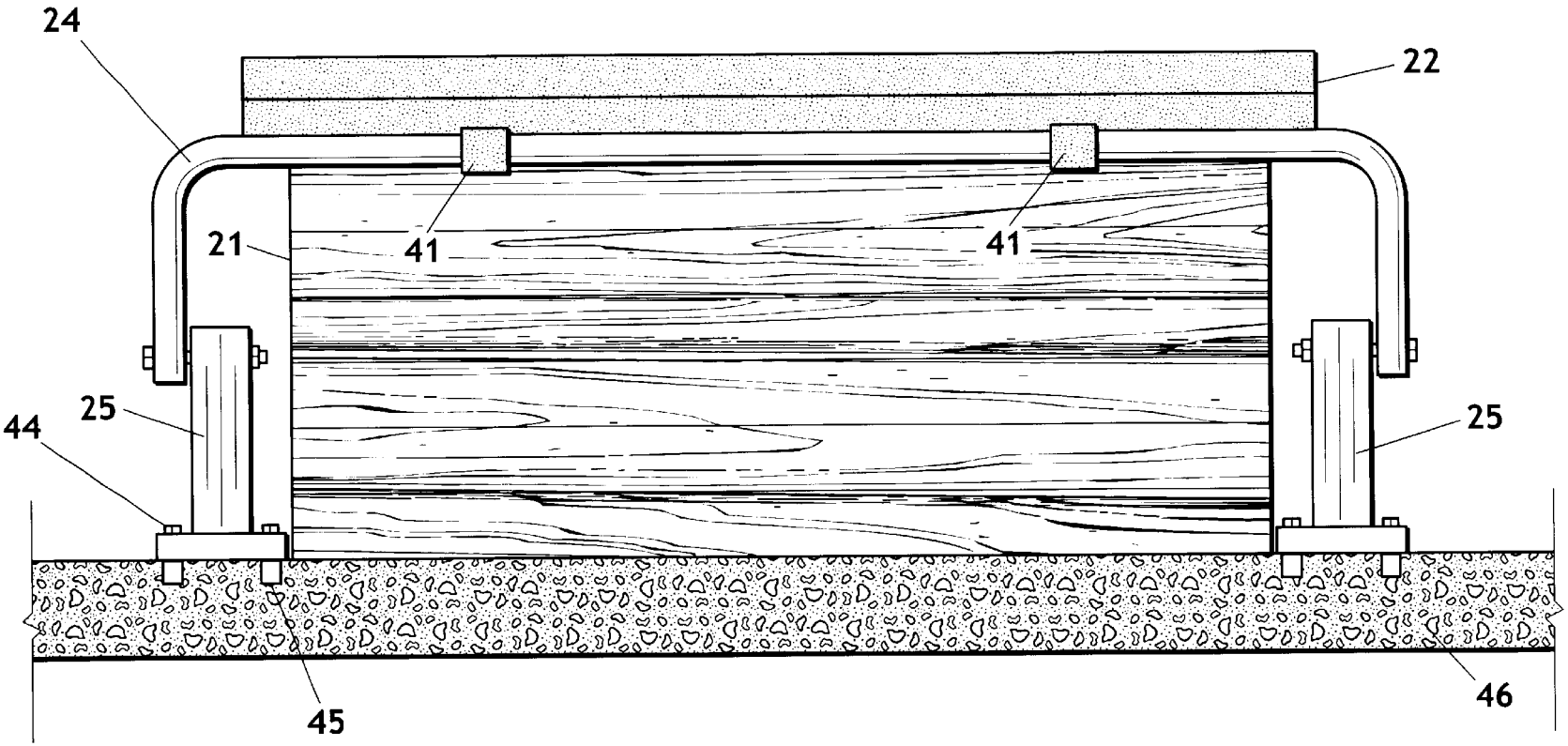
Figure 3:
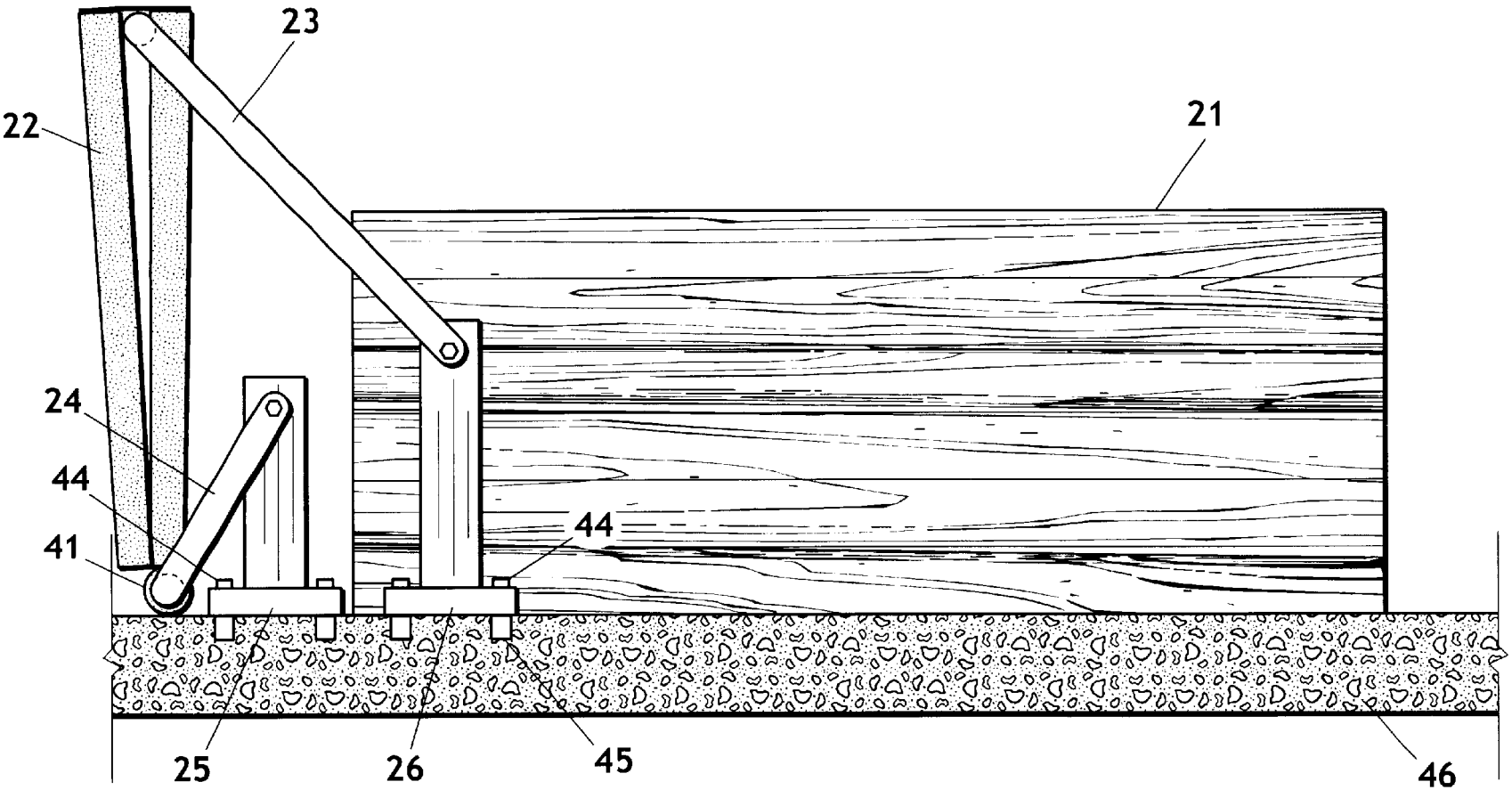

FIG. (2) is a end view of a spa with the cover shown in the "folded on" position. Right and left stanchions are shown attached to the ground slab or other mounting surface. The near lift bar is shown pivotally attached to the spa cover and stanchions.

FIG. (3) shows the cover in the stowed position.

DESCRIPTION OF THE INVENTION

FIG. (1) shows a spa (21) setting on a concrete pad (46) with spa cover (22) in the "folded on" position on the spa. Center lift bar (23) lays in position between the halves of spa cover (22). Near lift bar (24) is attached to the spa cover with straps (41). Stanchions (25 and 26) are attached to concrete pad (46) with bolts (44) and anchor nuts (45). Each end of the lift bars (23 and 24) is attached to its respective stanchion (25 and 26) with pivot bolts (27) and nuts (28).

FIG. (2) shows a spa (21) setting on a concrete pad (46) with spa cover (22) in the "folded on" position on the spa. Near stanchions (25) are attached to concrete pad (46) with bolts (44) and anchor nuts (45).

Each end of the near lift bar (24) is attached to its respective stanchion (25) with pivot bolts (27) and nuts (28).

FIG. (3) shows the position of the spa cover (22) and lift bars (23 and 24) when the cover is in the "folded off" position.

What is claimed is:

1. An apparatus for lifting a folding spa cover, having folding sections from a covering position over a spa to an uncovering position beside the spa the spa is setting on a concrete pad or decking comprising:

a U-shaped center lift bar adapted to be pivotally attached to one of the folding sections of the cover;

a U-shaped near lift bar adapted to be pivotally attached to said one of the folding sections of the cover;

two left and two right mounting stanchions on each side of the spa adapted for attachment to the concrete pad or decking upon which the spa is setting;

opposing legs of each bar being pivotally attached to a respective one of said stanchions.

* * * * *